US006698258B2

(12) United States Patent
Westwinkel

(10) Patent No.: US 6,698,258 B2
(45) Date of Patent: Mar. 2, 2004

(54) SWIVEL CRANK ARM

(75) Inventor: Florian Westwinkel, Toronto (CA)

(73) Assignee: Wesko Locks Ltd., Mississauga (CA)

( * ) Notice: Subject to any disclaimer, the term of this patent is extended or adjusted under 35 U.S.C. 154(b) by 109 days.

(21) Appl. No.: 10/166,777

(22) Filed: Jun. 12, 2002

(65) Prior Publication Data

US 2003/0221465 A1 Dec. 4, 2003

(30) Foreign Application Priority Data

May 30, 2002 (CA) ..... 2388230

(51) Int. Cl.[7] ..... E05B 65/46

(52) U.S. Cl. ..... 70/85; 70/69; 70/78; 70/84; 70/86; 312/219; 292/215

(58) Field of Search ..... 70/77, 78, 81–86, 70/69–71, 103, 108, 109, 113; 312/218, 219; 292/12, 27, 46, 47, 49, 117, 215

(56) References Cited

U.S. PATENT DOCUMENTS 3,596,952 A * 8/1971 Hinkle et al. ..... 292/27
3,767,280 A * 10/1973 McLaughlin ..... 312/219
3,776,007 A * 12/1973 Himsl ..... 70/86
4,239,309 A * 12/1980 De Fouw et al. ..... 312/221
4,246,769 A * 1/1981 McLaughlin ..... 70/85
4,365,490 A * 12/1982 Manzoni ..... 70/70
4,609,233 A * 9/1986 Walla ..... 312/219
5,257,860 A * 11/1993 Slivon ..... 312/218
5,385,039 A * 1/1995 Feldpausch et al. ..... 70/78
5,946,953 A * 9/1999 Feldpausch ..... 70/78
6,378,916 B1 * 4/2002 Huang ..... 292/27

* cited by examiner

*Primary Examiner*—Anthony Knight
*Assistant Examiner*—Christopher Boswell
(74) *Attorney, Agent, or Firm*—Squire, Sanders & Dempsey L.L.P.

(57) ABSTRACT

A rotating modular arm with two arm segments is used in a cabinet locking system. The two arm segments are urged apart by a spring. Each arm segment is connected to a lock bar. When the modular arm is rotated, the arm segments displace the lock bars to lock or unlock the drawers of the cabinet. One of the arm segments defines an elongated asymmetrical slot with two slot portions. The first slot portion is elongated and has a width that is less than the diameter of the second slot portion. A keyed lock housing includes a rotating lock core attached to a Z-shaped crank. A retainer is securely attached to the crank. The retainer has a diameter that is less than the diameter of the second slot portion, but the retainer diameter is greater than the width of the first slot portion. During installation, the retainer is engaged with the modular arm by first inserting the crank through the second slot portion. The crank is then displaced to engage the crank with the first slot portion so that rotation of the lock core will turn the crank and rotate the modular arm to displace the lock bars. A clip is not required to secure the crank to the modular arm. The two arm segments are connected with a releasable detent. A spring mounted on the exterior of one of the arm segments is used to urge the arms apart.

20 Claims, 10 Drawing Sheets

ASSEMBLY

P
2
4
6
8
12
14
17
18
20
22
24
26
28
30
32
34
36
38
40
42
43
47

PRIOR METHOD - page 2 of 4

130
E-CLIP
K
J
100
102
103
104
105
109
120
124
132
133
134
135

PRIOR METHOD - page 3 of 4

PRIOR METHOD - page 4 of 4

LOCKED POSITION

UN-LOCKED POSITION

SWIVEL CRANK ARM

FIELD OF THE INVENTION

The invention relates to a locking device for use in association with a cabinet locking system, a multi compartment storage unit and other locking devices.

BACKGROUND OF THE INVENTION

Many multi compartment storage units and other locking devices, including office furniture and storage fixtures, require locking mechanisms to secure the devices against unauthorized access to their contents. Often, the locking systems include locking bars that secure drawers and flapper covers against unauthorized opening. By way of background, US Pat. No. 4,246,769 issued to McLaughlin is an example of an earlier system used in association with cabinet locking systems. The McLaughlin patent teaches the use of a Z-shaped crank mounted on a locking core. The Z-shaped crank is positioned within a linear track provided within a multi-component arm. The crank is held in place within the linear track by a clip secured near the tip of the Z-shaped crank. It is important that the crank be secured for travel within the linear track. Accidental disconnection of the crank from the multi component arm could result in failure of the locking system.

The system disclosed in the McLaughlin patent and other earlier systems are also prone to other manufacturing or installation problems. For example, the locking systems are often designed for installation within confined spaces along the inner walls of a cabinet structure. Typically, very limited space is provided for installation and operation of the locking system and its components. Workmen who install the locking systems often find it difficult to work within those confined spaces. It is particularly difficult to insert the multi component arm into the proper location of the cabinet or other structure, mate the Z-shaped crank within the linear track, assemble the arm with the locking bars and affix the clip to secure the crank to the arm. The earlier multi component arms often became disassembled while the workmen attempted to install the locking system within the storage structure.

Some of the earlier systems were manufactured with various parts requiring numerous steps to properly assemble those components.

It is desirable that a new locking system be provided to reduce or replace the number of component parts required to assemble the multi component arm. It is also desirable to provide a replacement arm that may be more easily installed without the risk of accidental disassembly of the components of the arm. Similarly, it is preferred that the new locking system provide for improved ease of installation within the locking structure.

SUMMARY OF THE INVENTION

The present invention relates to a modular arm for use in a storage unit locking system. The modular arm contains an elongated asymmetrical slot for detachably securing a lock drive shaft with an integral retainer. The elongated asymmetrical slot contains first and second slot portions defining different widths across the longitudinal axis. The first slot portion spans a width less than that of the lock-drive shaft retainer. The second slot portion spans a width greater than that of the lock-drive shaft retainer.

Installation of the improved modular arm and lock housing unit does not require the use of a mounting clip. In addition, installation does not require the use of an internally mounted spring and ball bearing. Special tools are not required in typical installations. If required, the lock housing unit may be promptly detached from the modular arm in those instances where the lock housing unit is in need of repair or other service. For example, the externally mounted spring may be easily compressed to provide for rapid and easy removal of the lock housing unit of the entire cabinet locking system.

By comparison, conventional systems in the prior art often require special tools to permit removal of conventional retainers or springs, or in some cases, considerable physical effort and time are required to remove the retainers or springs from conventional housings.

In one aspect, the invention is a modular arm that defines a longitudinal axis. The modular arm may be used in a cabinet locking system. The modular arm includes first and second arm segments. The arm segments include actuators for operating lock bars positioned adjacent opposing inner walls of the cabinet. The first and second arm segments are operationally connected. One of the two arm segments defines an elongated asymmetrical slot. The slot extends along the longitudinal axis of the modular arm. The elongated slot includes first and second slot portions. The first slot portion defines a width that is less than the diameter defined by the second slot portion. The modular arm also includes a biasing element to urge the first and second arm segments between first and second positions defined along the longitudinal axis of the modular arm. When assembled, the modular arm may be detachably secured to a lock drive shaft of a lock housing assembly. The drive shaft of the lock housing assembly includes a retainer with a defined diameter. The diameter of the retainer is less than the diameter of the second slot portion. However, the diameter of the retainer is greater than the width of the narrower first slot portion.

In another aspect, the invention comprises a modular locking assembly which includes an arm assembly operatively connected to a lock housing assembly. The arm assembly includes first and second arm segments. The second arm segment is operatively connected to the first arm segment. The second arm segment or the first arm segment define an elongated asymmetrical slot that extends along the longitudinal axis defined by the arm assembly. The elongated slot comprises first and second slot portions. A biasing element is provided to urge the first and second arm segments between first and second positions along the longitudinal axis. The lock housing assembly includes a locking core that is operatively associated with an offset crank. The crank includes a lock drive shaft that is operatively engaged with the arm assembly, through the first slot portion, when the arm segments are in the second position. When the arm segments are in the first position, the crank is operatively disengaged, within the second slot portion, when the arm segments are in the first position. The lock housing assembly also includes a retainer having a defined diameter. The diameter of the retainer is greater than the width of the first slot portion. The diameter of the retainer is less than the diameter of the second slot portion.

In another aspect, the invention includes a storage unit. The storage unit comprises first and second lock bars that are slideably mounted adjacent to the inner walls of the storage unit. The storage unit also includes a modular arm and a lock housing assembly.

The modular arm includes first and second arm segments for operatively engaging the corresponding one lock bar of the two lock bars. The first and second arm segments are operatively connected. Either the first or second arm segment defines an elongated asymmetrical slot. The asymmetrical slot defines first and second slot portions. A biasing element is provided to urge the first and second arm segments between first and second positions along the longitudinal axis of the modular arm. The lock housing assembly includes a lock drive shaft that extends through the asymmetrical slot when assembled. The shaft comprises a retainer having a defined diameter. The diameter of the retainer is greater than the width of the first slot portion. The diameter of the retainer is less than the diameter of the second slot portion. The retainer may be withdrawn through the second slot portion when the first and second arm segments are in the appropriate position along the longitudinal axis.

In other aspects, additional features may be provided. The biasing element may take the form of a spring mounted on an exterior portion of one of the arm segments. A detent may also be provided for releaseably securing the first arm segment to the second arm segment. The detent may take the form of a projection on one of the first and second arm segments, and a stop on the other one of the first and second arm segments. When a portion of one of the arm segments is inserted into a receiving channel defined by the other of the arm segments, the projection engages a stop to releasebly secure the arm segments together. Additional embodiments of the invention are also possible.

BRIEF DESCRIPTION OF THE DRAWINGS

The following drawings are included to illustrate several examples of embodiments of the present invention.

DESCRIPTION OF PRIOR METHOD AND LOCK ASSEMBLY

Figures 1, 2, 3:
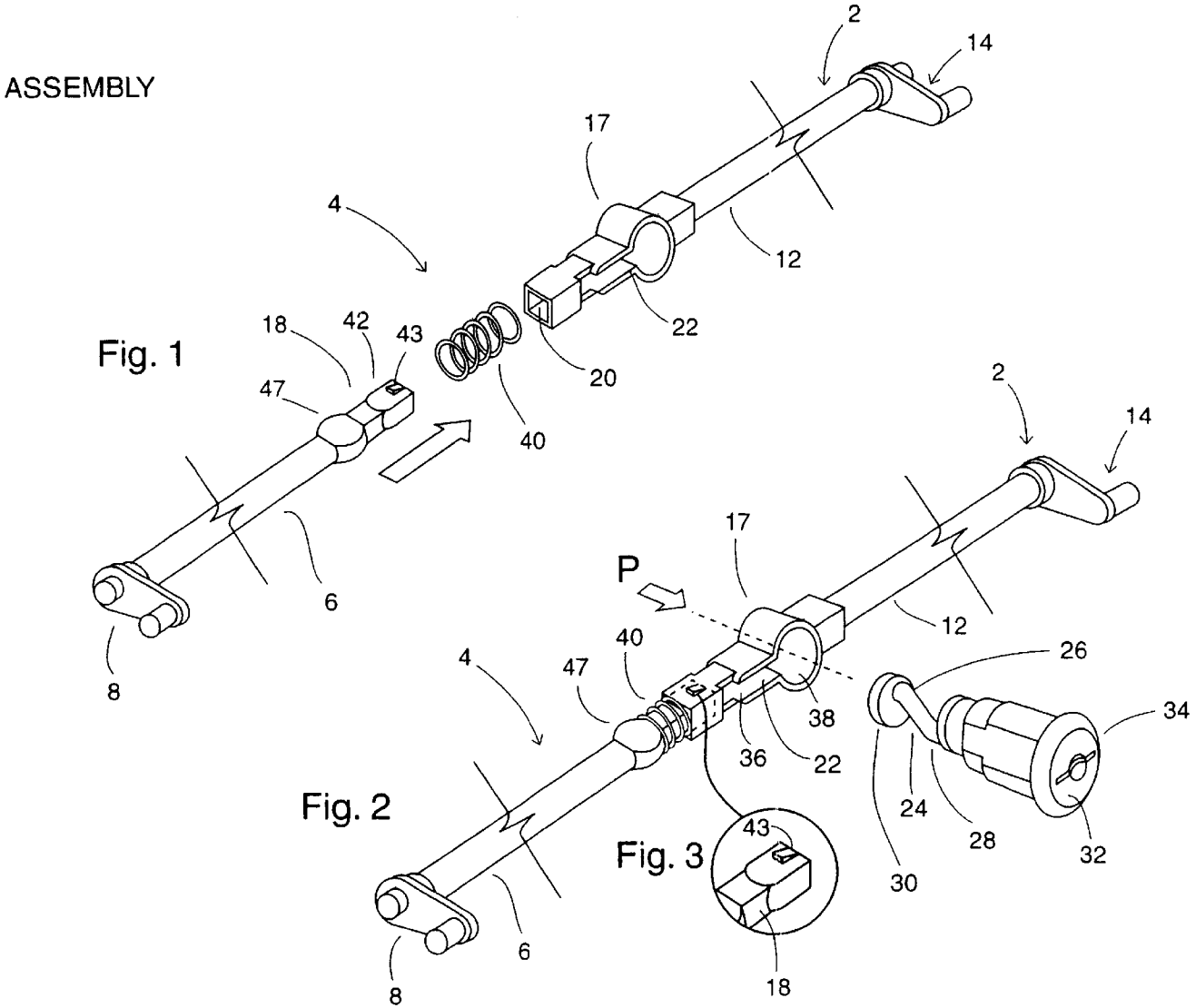
FIG. 1 is an exploded view of a modular arm for use in cabinet locking system.
FIG. 2 is a plan of the modular arm and the lock housing unit.
FIG. 3 is an elevation view of the post of the first arm segment.
Figures 1A, 2A, 3A:
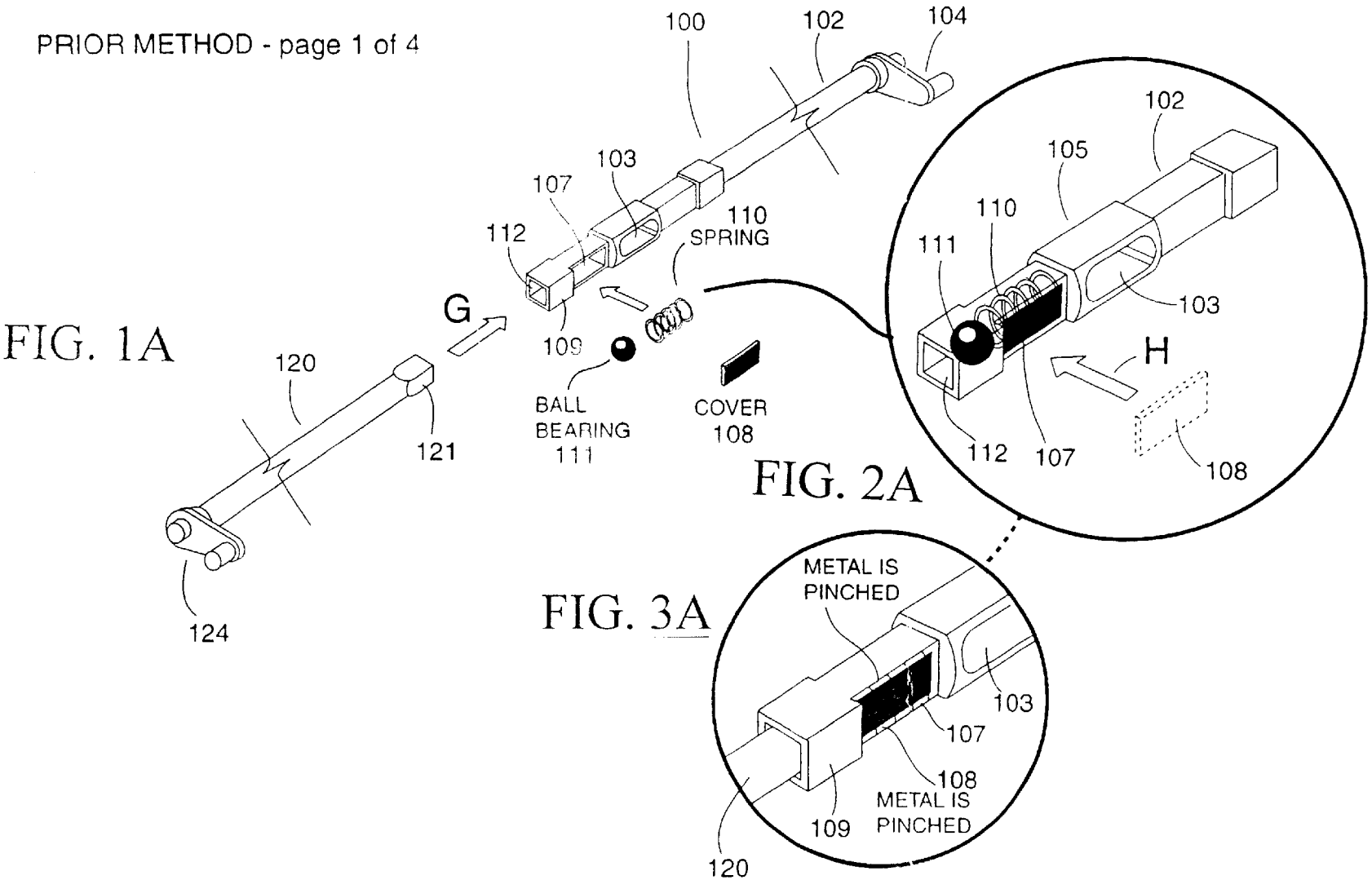
FIG. 1A shows an exploded perspective view of an earlier multi component modular arm.
FIG. 2A is an enlarged partial sectional view of a portion of the arm shown in FIG. 1A.
FIG. 3A is an enlarged partial sectional view of a portion of the arm segment shown in FIG. 2A.

FIG. 1A shows an earlier multi component arm used in a locking system for a storage cabinet. Arm 100 is made up of two arm sections 102 and 120. Stem 121 of arm segment 120 engages with opening 112 defined by driver end 109 of arm segment 102. Arm segments 102 and 120 are brought together along the path represented by arrow G. Arm segment 102 is loaded internally with a ball bearing 111 and a compression spring 110 through side opening 107. After the ball bearing 111 and compression spring 110 are loaded into a receiving chamber within the arm segment, the side opening 107 is sealed with a cover plate 108 as shown in FIGS. 2A and 3A. The cover plate 108 is moved toward arm segment 102 along the path of arrow H. The surrounding edge of the opening 107 is pinched to secure the cover plate to the arm segment 102. The opening 112 is configured to be smaller than the diameter of the ball bearing 111 so that the ball bearing will remain trapped within the corresponding arm segment. Stem portion 121 of arm 120 is allowed to slide within the interior channel of driver end 109. The two arm segments are urged apart by the interior spring and ball bearing assembly. However, if the two arm segments are not held together or held in place by additional structural elements, or by the installing workmen, there is a tendency for the arm segments to disconnect and become disengaged.

Arm segment 102 is also provided with an elongated opening or track 103 defined by a central housing portion 105. The track 103 opens through both sides of the arm segment 102. The opposing ends of the arm 100 are provided with lock bar actuators 104 and 124. The actuators 104 and 124 engage with lock bar assemblies on opposite sides of a cabinet structure so that lock bars will be displaced vertically when the arm is rotated about its longitudinal axis.

The assembled arm is installed within the cabinet structure so that the arm may rotate about its longitudinal axis. Typically, the opposing ends of the bar are positioned to engage support brackets or other suitable supports (not shown) mounted on the interior wall of the cabinet.

Figures 1B, 2B, 3B:
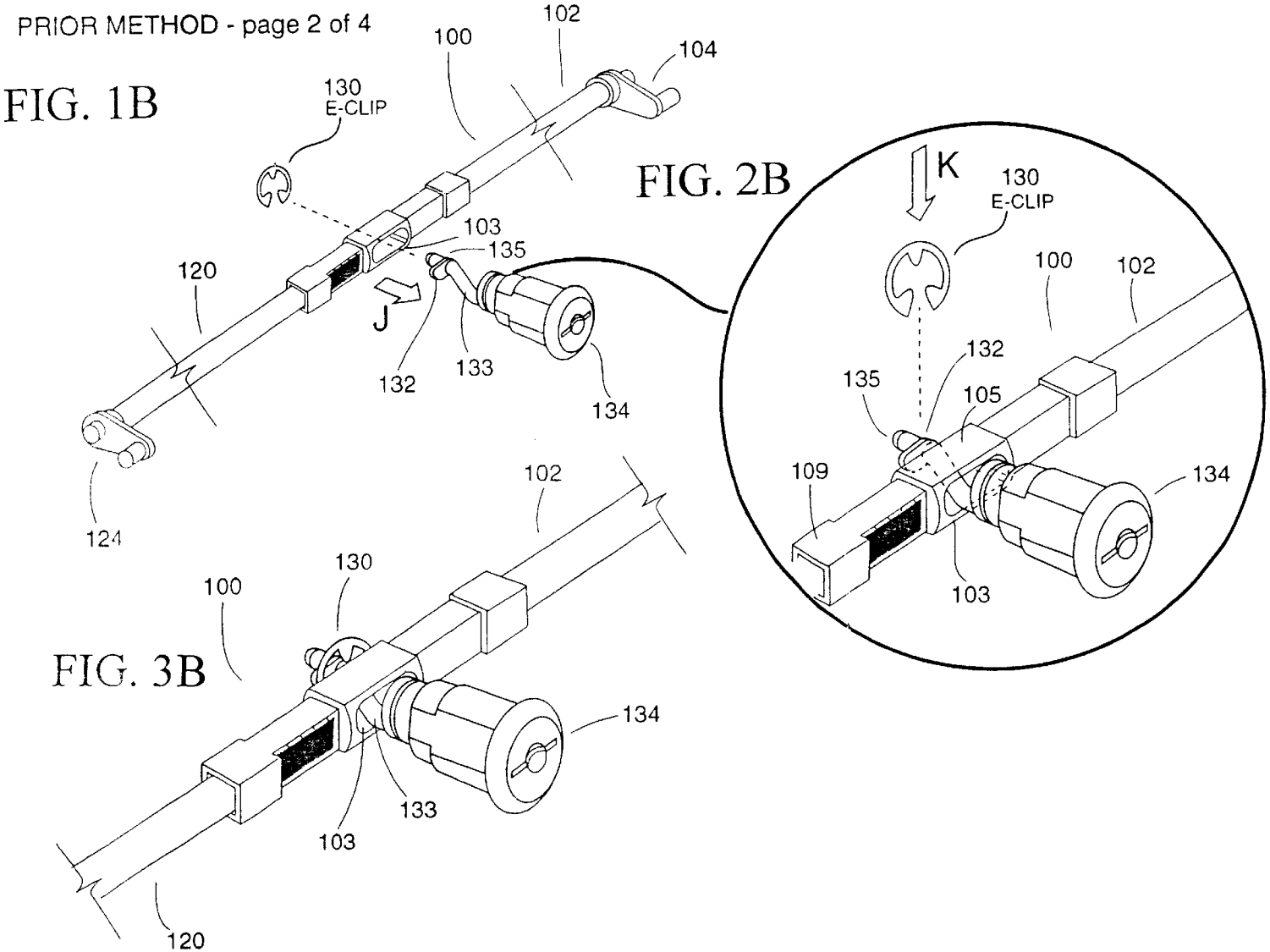
FIG. 1B is an exploded view of the earlier modular arm shown in FIG. 1A, together with an earlier locking core assembly.
FIG. 2B is an enlarged partial sectional view of a portion of the earlier modular arm and locking bar assembly of FIG. 1B.
FIG. 3B is a partial sectional view of the locking bar and arm assembly of FIG. 2B, in assembled configuration.

With reference to FIGS. 1B, 2B, and 3B, an assembled multi component arm 100 is typically brought toward a lock housing assembly 134 that was previously secured to a structural portion of the storage cabinet (not shown). Typically, the lock housing assembly 134 is first secured to the storage cabinet. Thereafter, the assembled arm 100 is installed within the cabinet by engaging Z-shaped crank 133 with linear track 103. The assembled arm is brought toward the preinstalled lock housing assembly along a path shown by arrow J. End 135 of crank 133 is inserted through track 103 so that end 135 extends beyond the opposite side of central housing 105. An E-clip 130 is affixed to end 135 of the crank, between clip retainer 132 of the crank and central housing 105. Typically, the clip is brought toward the crank end 135 along the path shown by arrow K. The clip 130 secures the crank 133 within the track 103 to prevent accidental separation of the crank 133 from the arm 100. Often, workmen encounter difficulties in properly securing the clips to the lock housing during installation.

FIGS. 1C, 1D, 1E and 1F show another embodiment of an earlier assembled arm and locking assembly installed within a locking cabinet. Cabinet 145 is provided with two locking drawers 147 and 149 that slide outwardly along mounting slides (not shown). Upper drawer 147 is shown in a partially open position. Lower drawer 149 is closed. Arm assembly 200 is mounted within the cabinet, adjacent the top wall of the cabinet. The arm is allowed to rotate about its longitudinal axis, when activated by the crank 233 and lock housing assembly 134. Clip 230 secures the lock housing assembly to the arm 200. Arm segment 220 is slidably engaged with driver end 209 of the other arm segment. The cabinet locking system includes lock bars 126 and 116 mounted adjacent opposite walls of the cabinet. The lock bars 126, 116, travel within channels (not shown) that are provided along the interior walls of the cabinet 145.

Figures 1C, 1D, 1E:
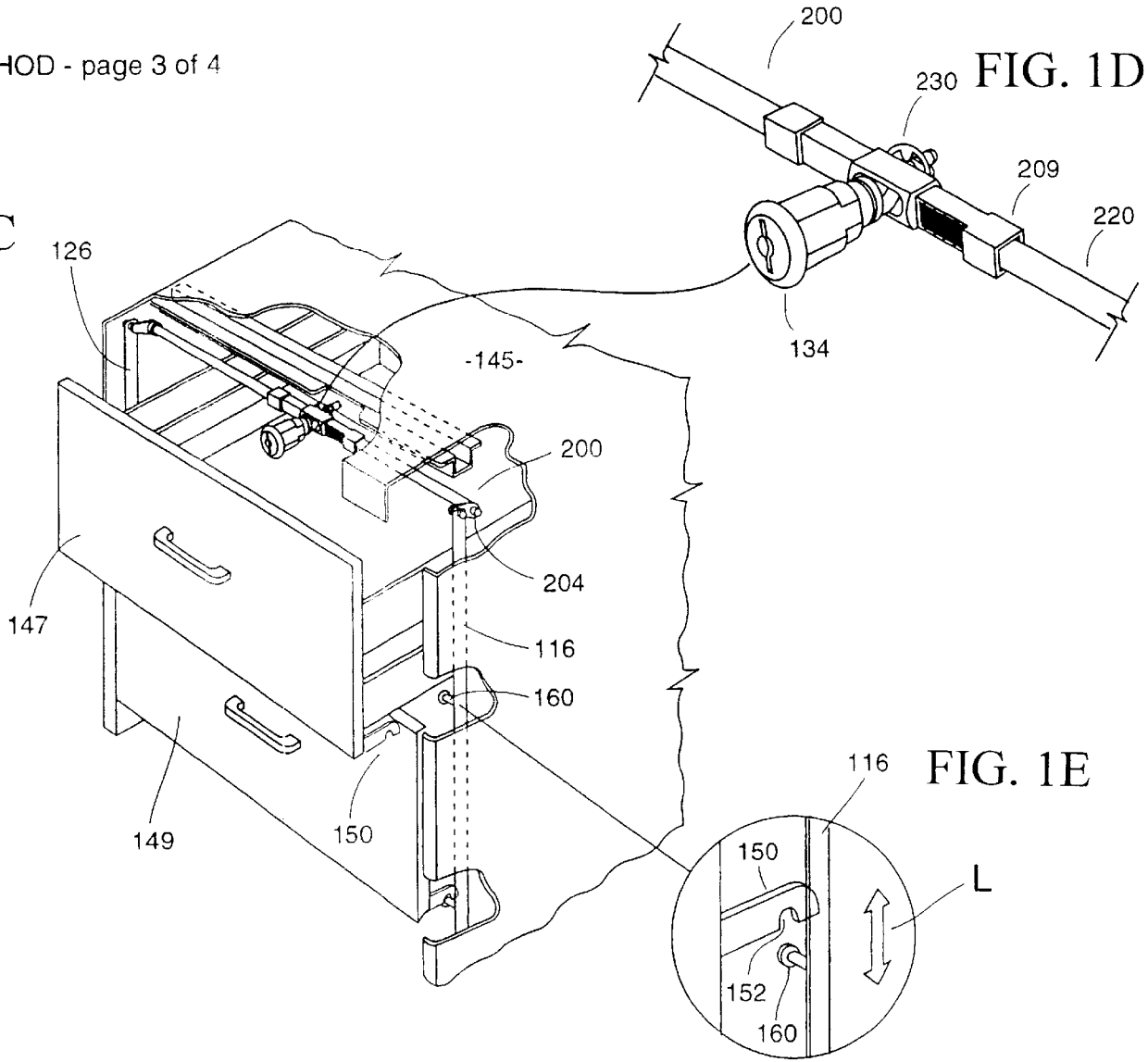
FIG. 1C is partial sectional view, in perspective, of an earlier cabinet structure with an installed drawer locking system.
FIG. 1D is an enlarged partial sectional view, in perspective, of an assembled locking core and modular arm assembly.
FIG. 1E is an enlarged partial sectional view of a portion of the earlier cabinet structure shown in FIG. 1C.
Figure 1F:
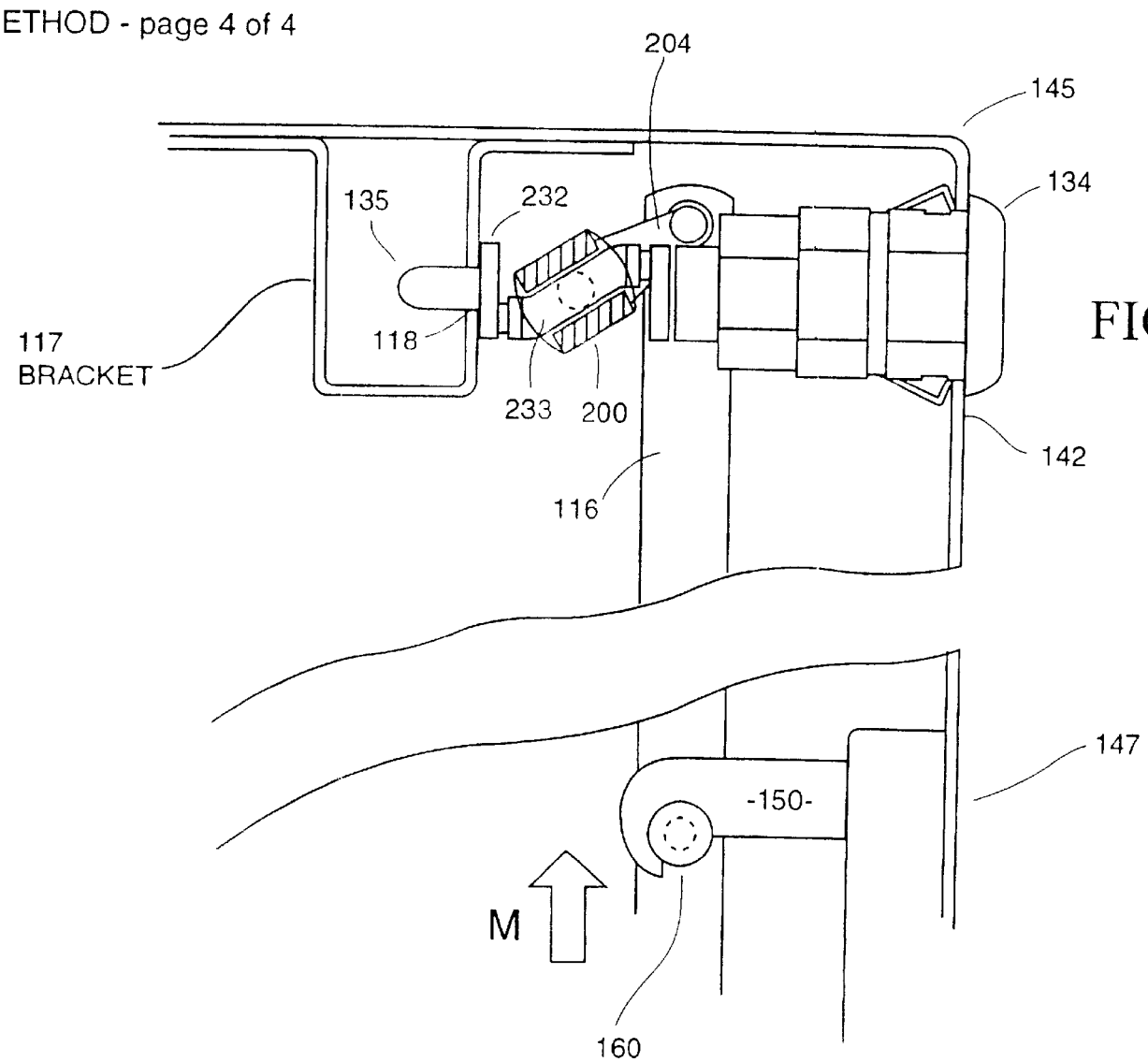
FIG. 1F is an enlarged partial cross sectional view of another portion of the earlier cabinet structure shown in FIG. 1C.

As shown in FIG. 1E, the lock bar 116 (and similarly lock bar 126) travels vertically along the channel as exemplified by arrow L. The lock bar is allowed to travel within a limited distance along that path. When the lock bar and the lock housing assembly are in the unlocked position, as shown in FIGS. 1C and 1E, the retainer hook 150 is disengaged from lock pin 152 extending from the lock bar 116. However, when the lock bar assembly is in the locked position, as shown in FIG. 1F, retainer hook 150 engages with lock pin 160 and the drawer is secured against opening. The drawer will be allowed to open once the corresponding retainer is disengaged from lock pin 160. The lock pin 160 will be disengaged from lock bar 116 when the lock core within the lock housing assembly 134 is activated, the lock core within the lock housing assembly 134 is rotated the appropriate amount to rotate the modular arm assembly and in turn, vertically displace the lock bars 116 and 126 along their respective channels.

In FIG. 1F, the lock housing assembly 134 is shown installed within an opening 142 near the top wall of the cabinet 145. The lock housing assembly 134 and arm assembly are located close to the upper wall, with limited clearance available for a workman to work within that confined space. The crank 233 is shown positioned and engaged within the inner track of arm assembly 200. Crank end 135 is rotatably mounted within opening 118 of mounting bracket 117. In this embodiment retainer 232 bears against an optional bracket 117 to inhibit excessive horizontal movement of the crank within the bracket mount. The lock housing assembly 134 is activated by inserting a key (not shown) into the key way of the locking core (not shown). By rotating the key, the lock core within the lock housing assembly 134 is rotated and in turn, the crank 133 is rotated about its axis of rotation. When the crank 133 is rotated, the Z-shaped crank acts on the arm assembly and in turn, rotates the arm about its longitudinal axis. It will be noted that the axis of rotation of the crank is perpendicular to the axis of rotation of the arm assembly. When the arm assembly 200 is rotated about its axis, the actuator 204 (which is engaged with lock bar 116) rotates in an arcuate path about the axis of rotation of the arm 200. When the lock housing assembly 134 is moved into a locked position along path M, the lock pin 160 is lockably engaged with retainer 150 of the corresponding upper drawer 147. When the lock housing is activated to the unlocked position, the lock bar is displaced vertically down along an opposite path so that pin 160 disengages from the retainer 150 and the drawer is allowed to open.

DETAILED DESCRIPTION OF A PREFERRED EMBODIMENT

FIGS. 1 to 9 show a preferred embodiment of the present invention. A cabinet locking system 2 is shown in exploded views in FIGS. 1 and 2. The locking system 2 includes a modular arm 4 that is generally cylindrical in shape. It will be understood in the art that the overall shape of the modular arm may vary according to the particular applications under consideration. In general, the overall shape of the modular arm will define a longitudinal axis. The modular arm comprises a first arm segment 6 having a first actuator 8 for operatively engaging a first lock bar 10 (shown in FIG. 8). The modular arm 4 further comprises a second arm segment 12 having a second actuator 14 for operatively engaging a second lock bar 16. The first arm segment 6 defines a post 18 extending along the longitudinal axis. The post 18 operatively engages a receiving channel 20 defined by the second arm segment 12.

The second arm segment 12 is equipped with an elongated asymmetrical slot 22. The elongated asymmetrical slot 22 extends along the longitudinal axis and detachably secures a lock drive shaft 24 extending across the axis. The lock drive shaft 24 is a generally rod shaped member having a double offset 26 and 28 so as to comprise a zigzag shape. A retainer 30 forms the rear portion of the lock drive shaft 24. The retainer 30 extends radially about an axis that generally coincides with the longitudinal axis of the lock housing unit 34.

The opposite end of the lock drive shaft 24 is connected to a locking core 32. The retainer 30, the lock drive shaft 24, the locking core 32, and an outer core housing are included in the lock housing unit 34. The elongated asymmetrical slot 22 comprises a first slot portion 36 and second slot portion 38 defining different widths across the longitudinal axis. The retainer 30 spans a width greater than the width of the first slot portion 36 and less than the width of the second slot portion 38.

FIGS. 2, 4, 6, 10*b* and 11*b* show one embodiment of the retainer which is generally circular in cross-section. However, it will be appreciated that the retainer 30 may take the form of one of many other possible shapes. By way of example, the retainer 30 may take the form a wafer of elongated shape when viewed in cross-section. The retainer 30 may either be made from a work piece separate from the lock drive shaft 33, or the crank and retainer may be cast as a single work piece. It is preferable that the retainer be attached to the crank prior to connection of the lock housing assembly to the crank arm assembly. The retainer 30 may be bolted, screwed or otherwise securely fastened to the lock drive shaft 33. The particular method of securing the retainer to the crank is not an essential feature of the invention. However, skilled persons in the art will appreciate that the configuration and strength of the materials selected to make the retainer 30 and other components of the lock housing assembly may be designed to enhance the overall strength of the mechanical link between the lock housing assembly and the modular arm assembly after the units are assembled and installed within the storage unit. Various means may be used to securely fasten the retainer 30 to the lock drive shaft 33 that would be superior to the retention capabilities of a clip or other snap-like device used in conventional applications.

By way of further example, the retainer 30 may have an irregular shape, other than the generally circular shape as shown in FIGS. 2, 4, 6, 10*b* and 11*b*. For example, if the retainer 30 takes the shape of an elongated member, such as an elliptical, oblong, oval or other generally elongated wafer-like shape, that configuration will have a major axis (corresponding to a length) and a minor axis (corresponding to the width) of the retainer configuration. In general terms, the retainer will define an effective diameter. In a circular retainer configuration, the diameter is measured across the centre point of the circular shape. With irregular shapes, the effective diameter of the irregularly shaped retainer will often correspond to the minimum effective width measured across the irregularly shaped retainer. To inhibit accidental withdraw of the retainer 30 through the narrower block portion 36, the effective diameter of the retainer 30 is greater than the width of narrower slot portion 36.

The first arm segment 6 and second arm segment 12 are moveable between compressed and extended positions by means of spring 40. The spring 40 is externally mounted on a first intermediate portion 42 of the first arm segment 6. Raised abutment 43 is provided on post 18 to inhibit the arm segments from complete disengagement. The spring 40 acts on the leading edge of arm segment 12 and spring stop 47 to urge the two arm segments apart. However, the raised abutment 43 engages an inner ridge (not shown) within opening 20 to form a detent. The detent provides sufficient resistance against the force of the spring to inhibit accidental separation of the two arm segments. If a workman wishes to separate the two components, the workman may provide the additional force or appropriate orientation to separate the arm segments.

Figures 4, 5, 6, 7:
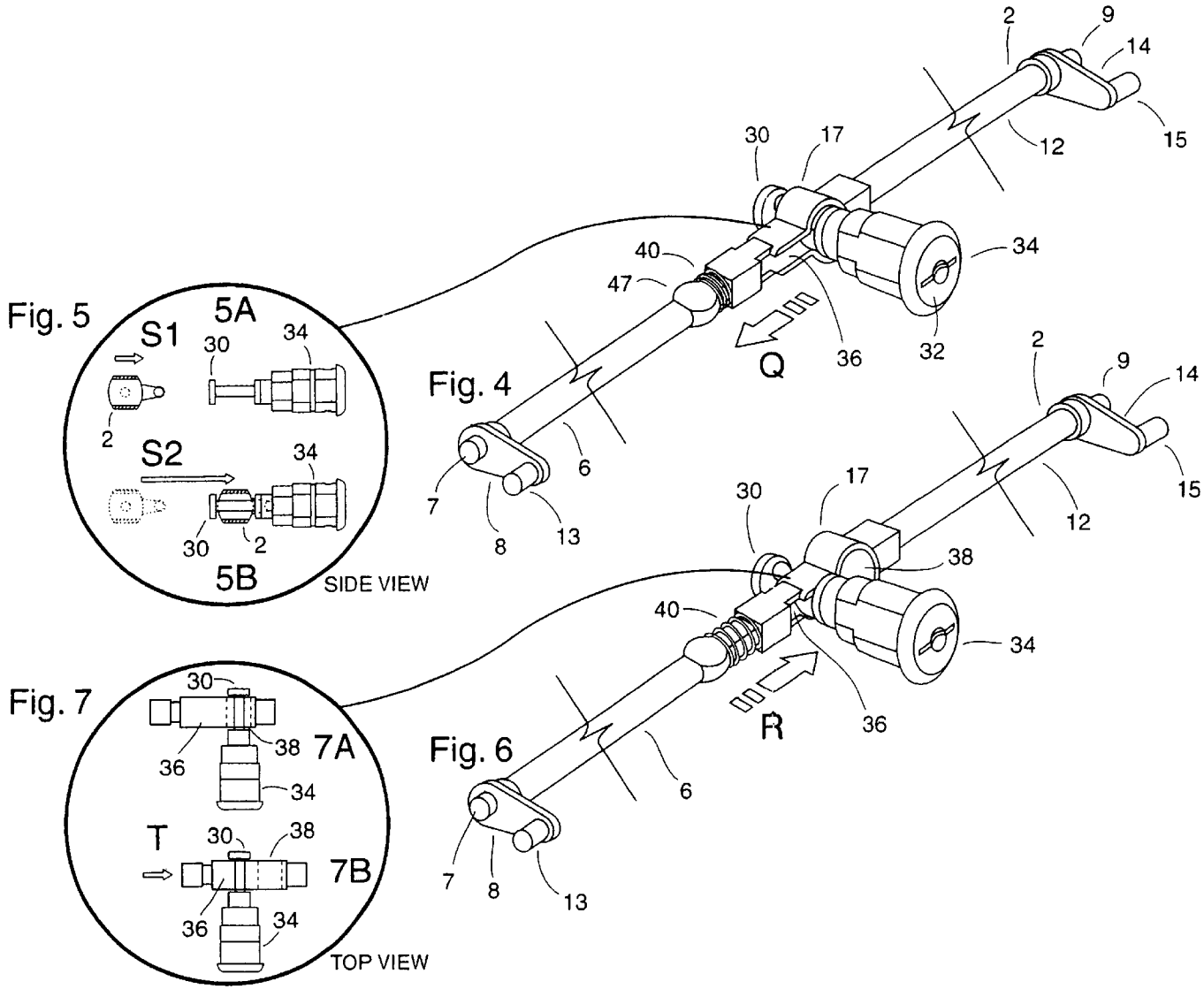
FIG. 4 is a perspective view of the modular arm and the lock housing unit in the uninstalled position.
FIG. 5 is a side perspective view of the lock housing unit illustrating installed and uninstalled positions.
FIG. 6 is a perspective view of the modular arm and the lock housing unit in the installed position.
FIG. 7 is a top perspective view of the lock housing unit illustrating installed and uninstalled positions.
Figures 8, 9:
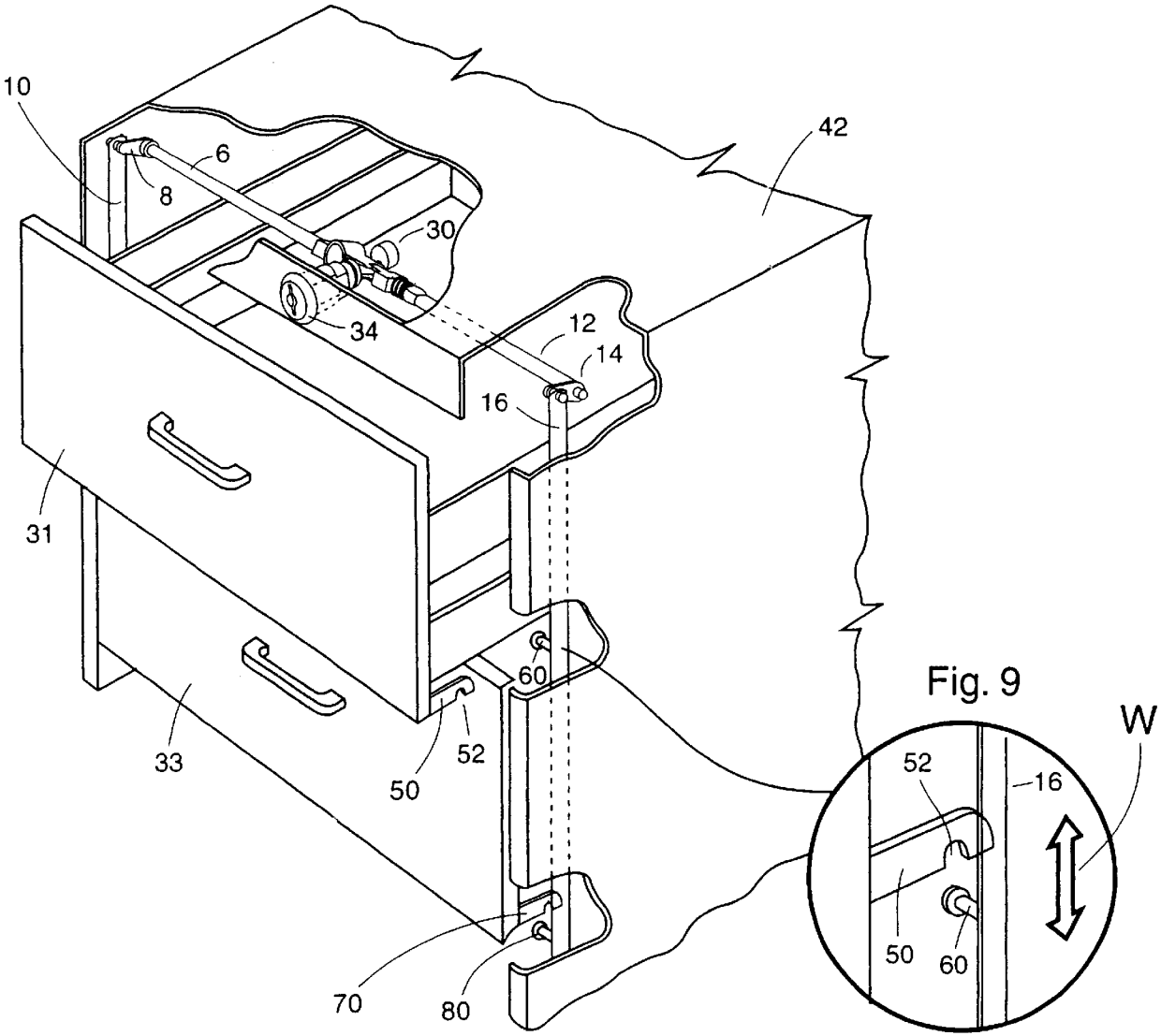
FIG. 8 is an exploded perspective view of the preferred embodiment of the invention for use in a two-drawer cabinet illustrating the modular arm and the lock bars.
FIG. 9 is a plan view of a lock bar stud and drawer hook.

With reference to FIGS. 2, 4 and 5, during installation, the two arm segments are urged together and the spring 40 is compressed. When the spring 40 is fully compressed there is sufficient clearance for the modular arm 2 to enter into the cabinet 42 (shown in FIG. 8). The arm 4 is brought toward the lock housing assembly (which is first mounted within the cabinet structure). The arm 4 is moved along the direction indicated by arrow P (or S1 and S2 in FIGS. 5A and 5B) and is also compressed along direction Q so that the retainer 30 on the terminal end of drive shaft 24 is able to pass from one side of the arm housing 17 through the larger slot portion 38 and to the other side of the arm housing 17. The arm 4 is then released and the spring 40 urges the two arm segments apart along the direction indicated by arrow R in FIG. 6 (or, along arrow T, as illustrated in FIGS. 7A and 7B). As the spring 40 urges the arm segments apart, the drive shaft 24 of the crank moves from within wider slot portion 38 and becomes positioned within the narrower slot portion 36 of the housing 17. When in operation, the lock drive shaft 24 extends through the narrower slot portion 36 of the elongated asymmetrical slot 22. Thus, when the drive shaft 24 is situated within the narrower slot portion 36, the retainer 30 abuts against the rearmost outer edges of the housing 17 to prevent accidental withdrawal of the drive shaft 24 from the housing.

During the installation procedure, the arm assembly 4 is mounted within the cabinet so that it may rotate about its longitudinal axis. Often, mounting brackets (not shown) will be provided on opposite walls of the cabinet, so that posts 7 and 9 will mate with corresponding circular openings in the mounting brackets (not shown). The posts 7 and 9 will rotate within those circular openings when the arm assembly is activated by rotation of the locking core assembly. Drive pins 13, 15 on actuators 8 and 14 are rotatably engaged with the lock bars 10 and 16 so that, when the actuators are rotated, the connected lock bars are moved vertically within their respective tracks or channels adjacent the inner cabinet walls (not shown).

The improved locking assembly 2 of the present invention is shown in FIGS. 8 to 11*c* as being installed in a conventional two drawer locking cabinet 42. Lock housing assembly 34 is installed within a face plate of the cabinet 42. In FIGS. 8, 9, 11*a*, 11*b*, and 11*c*, the locking assembly including the locking bars are in the unlocked position. That is, the upper and lower drawers 31, 33 are unlocked. Drawer retainers 50 and 70 are disengaged from lock bar 16 and similarly lock bar 10 is disengaged from the corresponding retainers (not shown) on the opposite side wall of the upper and lower drawers.

Figure 11A:
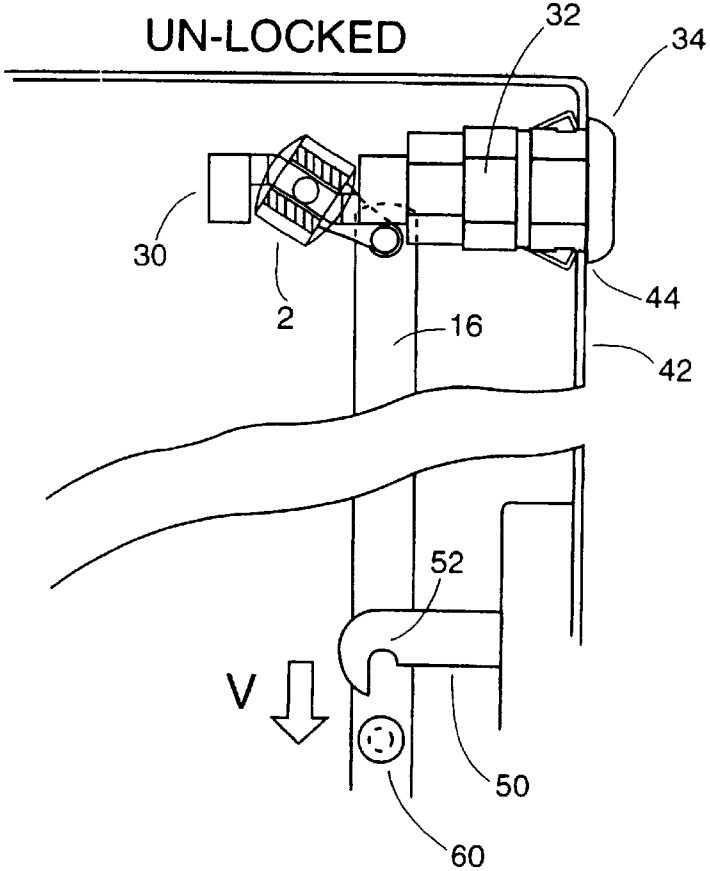
FIGS. 11*a* and 11*c* are side perspective views of the cabinet locking system illustrating the unlocked position.
Figure 11B:
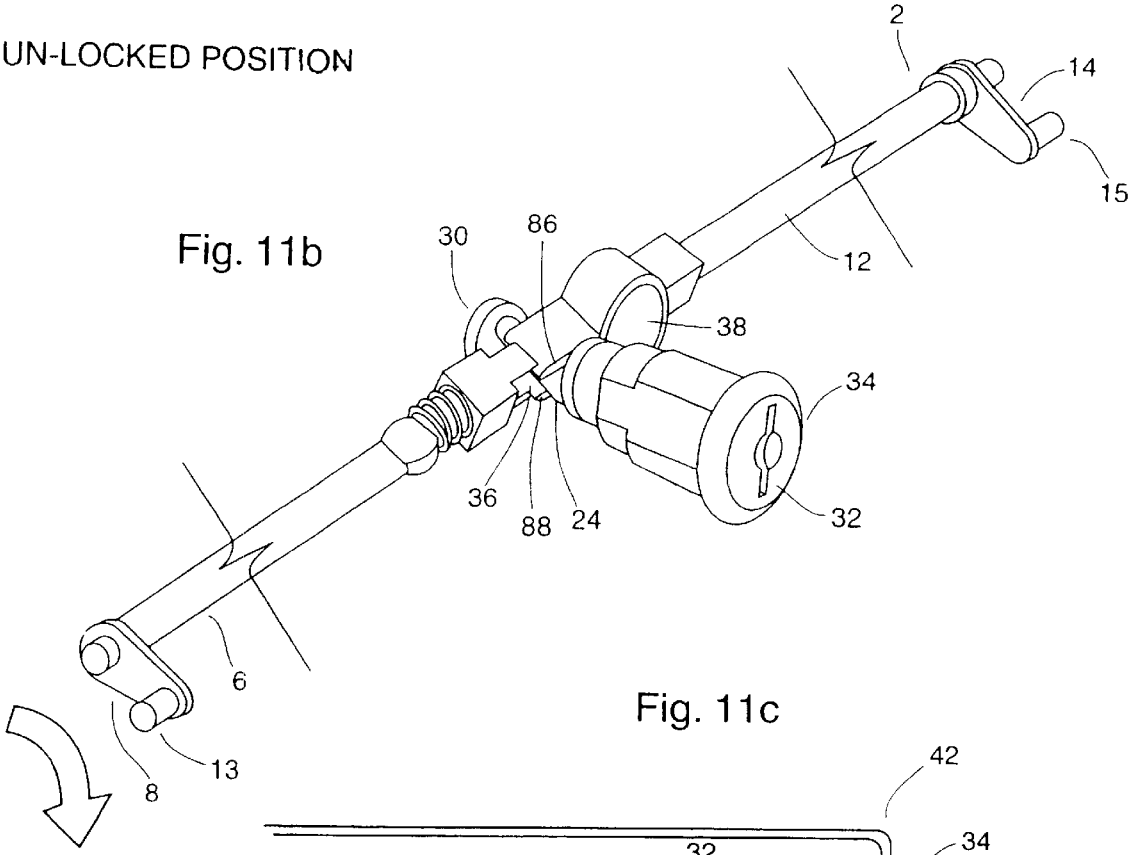
FIG. 11*b* is a perspective view of the modular arm and lock housing unit in the unlocked position.
Figure 11C:
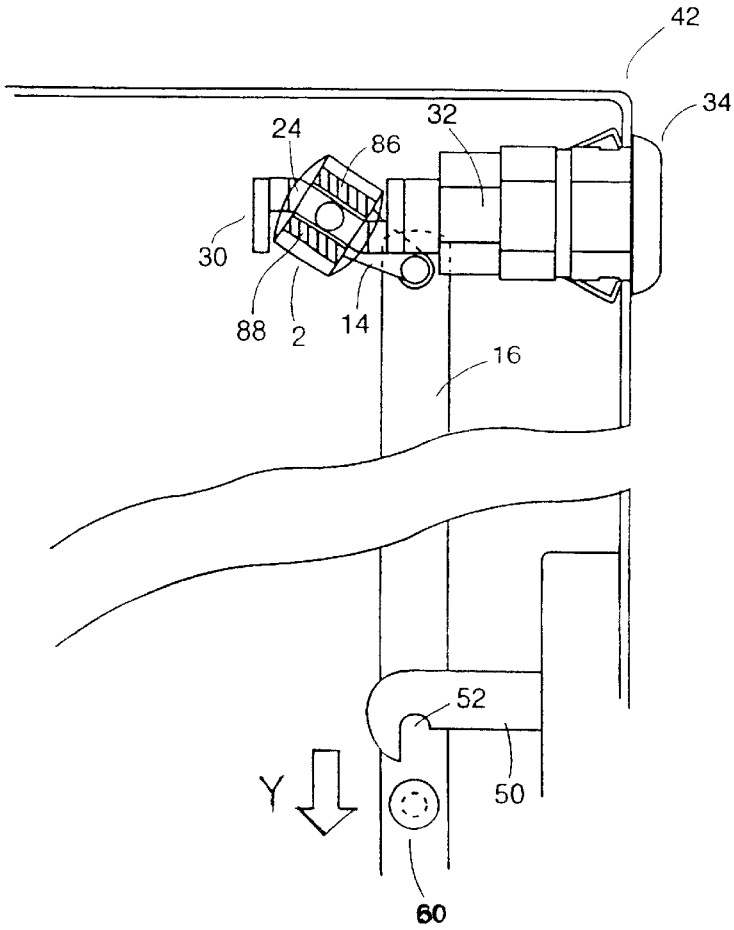

In the unlocked position (as shown in FIGS. 11*a*, 11*b* and 11*c*), the lock bars 16 and 10 (the latter lock bar 10 is not shown) are moved to a downward position (indicated by arrow V in FIG. 11*a*) when the lock arm 2 and the locking core 32 are moved to the unlocked position. By way of example, as shown in FIGS. 11*a*, 11*b*, and 11*c*, the locking core 32 is in the unlocked position. When the locking core 32 is rotated to the unlocked position, lock drive shaft 24 bears on upper and lower slot walls 86 and 88 of the narrower slot portion 36 to rotate the arm 2 to the unlocked position. Actuator 14 in turn rotates to downwardly displace the lock bar 16 to the unlocked position. As a result, stud or pin 60 is disengaged from hook portion 52 on retainer 50 and the corresponding drawer 31 is allowed to open.

Locking core 32 is rotatable within the lock housing assembly 34. One of several types of locking cores may be used. For example, conventional locking cores can provide for a 90 degrees rotation between locked and unlocked positions, and when rotated from the unlocked position to the locked position. Other locking cores provide for 180 degrees rotation between the locked and unlocked positions. Of course, other variations are possible, and are not essential to the scope of the present invention. Often, designers will use one of the conventional locking cores with an appropriate degree of rotation that will be suitable to provide the necessary degree of displacement of the lock bars when the locking core, and ultimately, the modular arm assembly are rotated between locked and unlocked positions.

Figure 10A:
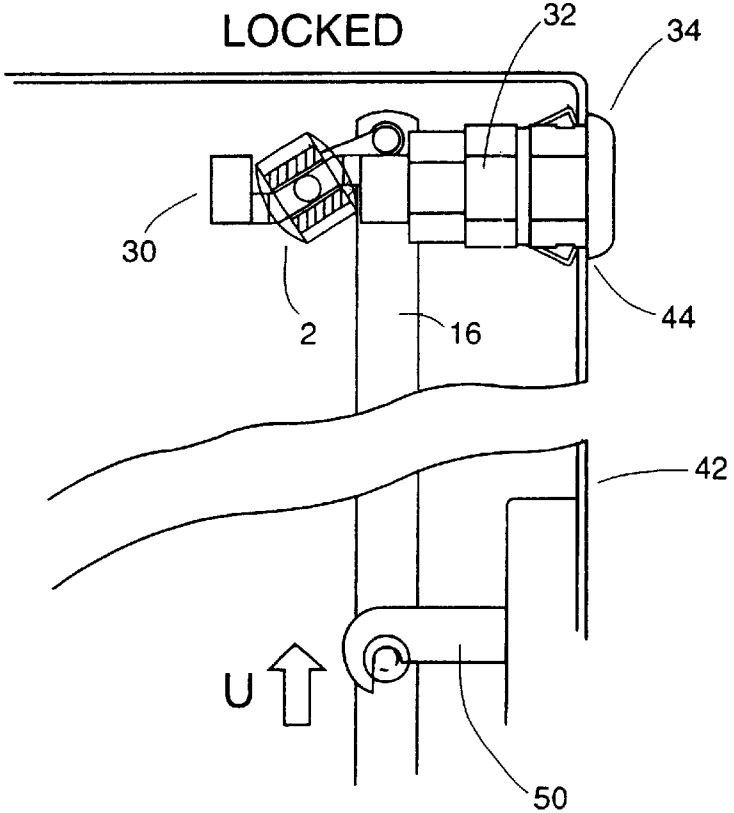
FIGS. 10*a* and 10*c* are side perspective views of the cabinet locking system illustrating the locked position.
Figure 10B:
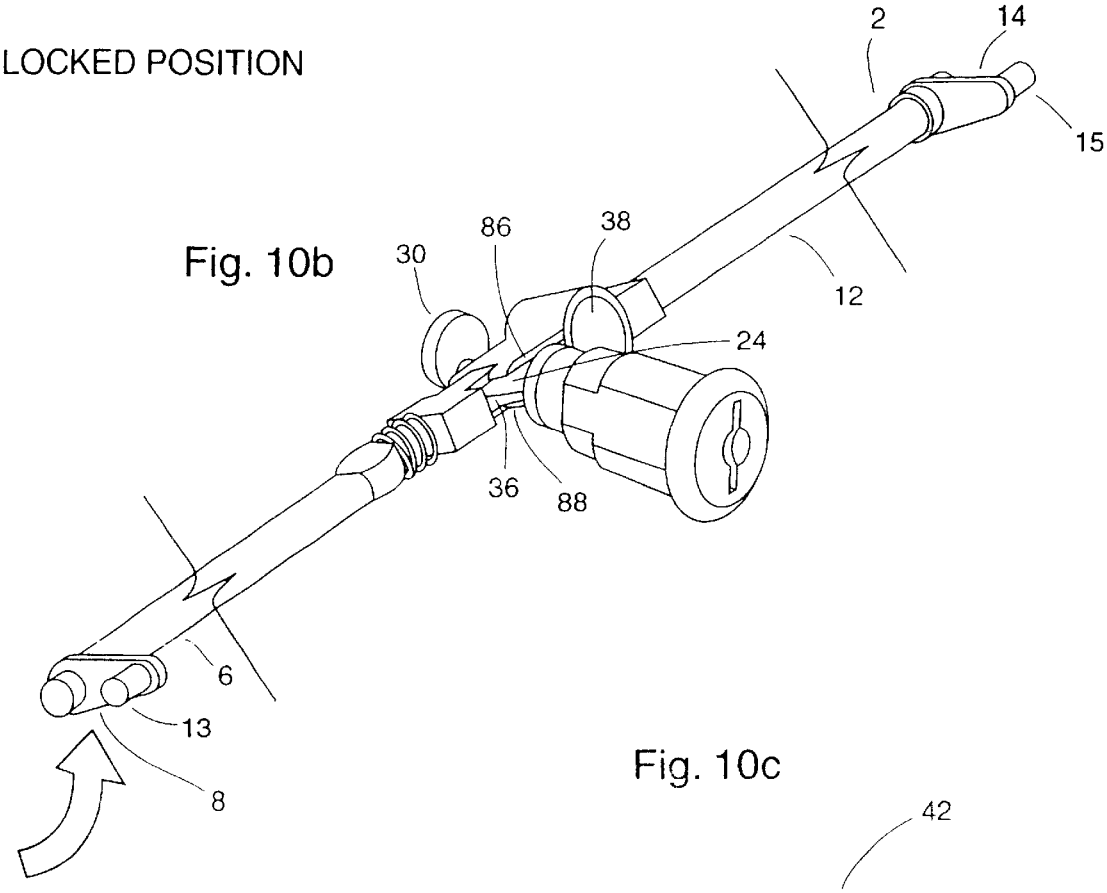
FIG. 10*b* is a perspective view of the modular arm and lock housing unit in the locked position.
Figure 10C:
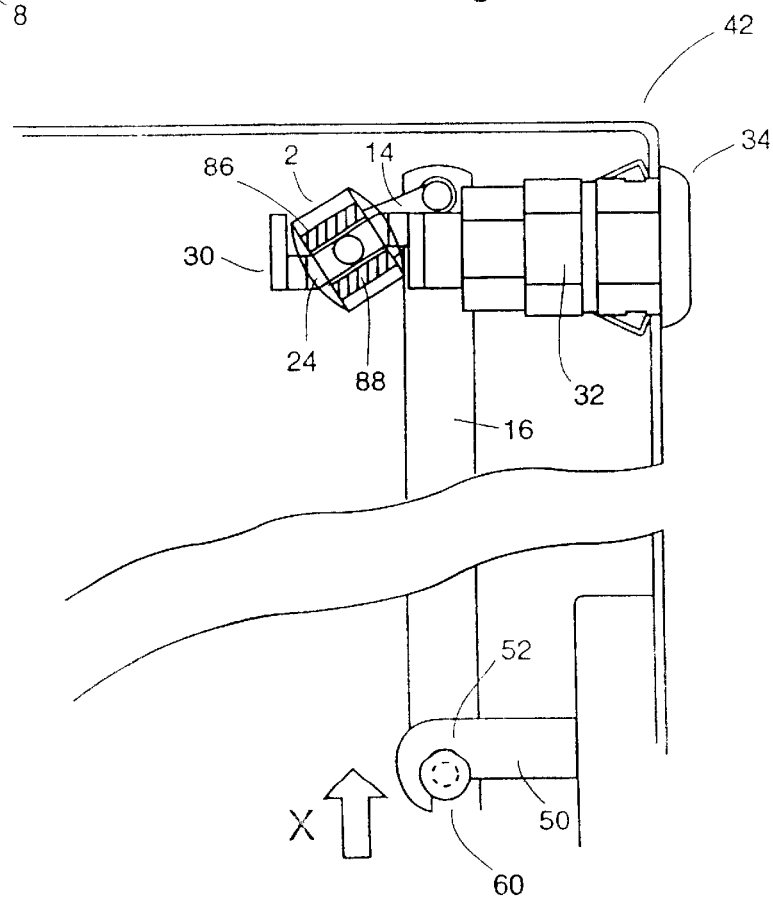

In the locked position (as shown in FIGS. 10*a*, 10*b* and 10*c*), the lock bars 16 and 10 (the latter lock bar 10 is not shown) are moved to a upward position (indicated by arrow U in FIG.10*a*) when the lock arm 2 and the locking core 32 are moved to the locked position. By way of example, as shown in FIG. 10*a*, 10*b*, and 10*c*, the locking core 32 is in the locked position. When the locking core 32 is rotated to the locked position, lock drive shaft 24 bears on upper and lower slot walls 86 and 88 of the narrower slot portion 36 to rotate the arm 2 to the locked position. Actuator 14 in turn rotates to upwardly displace the lock bar 16 to the locked position. As a result, stud or pin 60 is engaged with hook portion 52 on retainer 50 when the corresponding drawer 31 is in the fully closed position. Accordingly, the drawer 31 is locked to prevent unauthorized access to its contents.

It will be appreciated from the foregoing description that several potential advantages are provided by employing one or more of the features of the present invention. For example, the provision of a detent feature in the arm assembly will inhibit the accidental disassembly or separation of the arm segments of the arm assembly during transportation, assembly or otherwise. The spring may be mounted externally on one of the arm segments without the use of added parts such as a cover plate or ball bearing. In addition, the two part slot design provides the workman with a simplified mechanism for installation of the arm assembly into the cabinet or other storage structure. The retainer portion provided adjacent the end of the drive shaft may be made from a single work piece, or the retainer portion may be affixed to the drive shaft at a convenient time prior to assembly of the arm and lock housing assembly within the storage structure.

The embodiments described in this specification are merely illustrative and are not intended to limit the invention to the specific features, elements or steps as described herein. Further and other modifications and variations will be apparent to those skilled in the art, thus making it possible to practice the other embodiments of the invention, all of which are within the spirit and scope of the present invention.

I claim:

1. A modular arm defining a longitudinal axis for use in a storage unit locking system comprising:

(a) a first arm segment comprising a first actuator for operatively engaging a first lock bar, (b) a second arm segment for operational connection to the first arm segment, the second arm segment or the first arm segment defining an elongated asymmetrical slot extending along the longitudinal axis for detachably securing a lock drive shaft extending across the axis, the shaft comprising a retainer with a defined diameter, the elongated slot comprising first and second slot portions, the first slot portion defining a width less than the diameter of the retainer, and the second slot portion defining a diameter greater than the diameter of the retainer, the second arm segment comprising a second actuator for engaging a second lock bar, and (c) a biasing element for urging the first and second arm segments between first and second positions defined along the longitudinal axis.

2. The modular arm claimed in claim 1 wherein the biasing element is mounted externally of a first intermediate portion of the first arm segment.

3. The modular arm claimed in claim 1 wherein the first arm segment defines a post extending along the longitudinal axis and operatively engaging a receiving channel defined by the second arm segment.

4. The modular arm claimed in claim 3 wherein the first arm segment is releasably secured to the second arm segment.

5. The modular arm claimed in claim 4 comprising a detent for releasably securing the first and second arm segments.

6. The modular arm claimed in claim 5 wherein the detent comprises: a projection on one of the first and second arm segments; a ridge on the other of the first and second arm segments; and the projection engaging the ridge when the post is inserted into the receiving channel.

7. The modular arm claimed in claim 6 wherein the biasing element is mounted externally of a first intermediate portion of the first arm segment.

8. The modular arm claimed in claim 7 wherein the biasing element is a spring.

9. The modular arm claimed in claim 8 wherein the spring is positioned between a stop defined by the first arm segment and an outer wall defining the periphery of the receiving channel.

10. The modular arm claimed in claim 9 wherein a shape defined by the retainer corresponds to a shape defined by the second slot portion and does not correspond to a shape defined by the first slot portion.

11. A modular locking assembly comprising:

(i) an arm assembly defining a longitudinal axis comprising:

(a) a first arm segment comprising a first actuator for operatively engaging a first lock bar, (b) a second arm segment operatively connected to the first arm segment, the second arm segment or the first arm segment defining an elongated asymmetrical slot extending along the longitudinal axis, the elongated slot comprising first and second slot portions, the second arm segment comprising a second actuator for engaging a second lock bar, and (c) a biasing element for urging the first and second arm segments between first and second positions defined along the longitudinal axis; and (ii) a lock housing assembly comprising:

(a) a locking core operatively associated with an offset crank, the crank comprising: a lock drive shaft operatively engaged with the arm assembly through the first slot portion when the arm segments are in the second position, and the crank is operatively disengaged within the second slot portion when the arm segments are in the first position; and an end remote from the locking core; and (b) a retainer with a defined diameter located adjacent the remote end; and the first slot portion defining a width less than the diameter of the retainer, and the second slot portion defining a diameter greater than the diameter of the retainer.

12. The modular locking assembly of claim 11 wherein the biasing element is a spring mounted externally of the first arm segment.

13. The modular locking assembly of claim 11 comprising a detent for releasably securing the first arm segment to the second arm segment.

14. The modular locking assembly of claim 13 wherein the first arm segment defines a post extending along the longitudinal axis and operatively engaging a receiving channel defined by the second arm segment.

15. The modular locking assembly of claim 14 wherein the detent comprises: a projection on one of the first and second arm segments, and a stop on the other of the first and second arm segments; and the projection engaging the stop when the post is inserted into the receiving channel.

16. The storage unit claimed in claim 11 wherein the biasing element is a spring mounted externally of the first arm segment.

17. The storage unit claimed in claim 16 wherein a shape defined by the retainer corresponds to a shape defined by the second slot portion and does not correspond to a shape defined by the first slot portion.

18. A storage unit comprising:

(i) a first lock bar slidably mounted adjacent a first inner wall of the storage unit, and a second lock bar slidably mounted adjacent a second inner wall opposite the first inner wall;

(ii) a modular arm, defining a longitudinal axis, comprising:

(a) a first arm segment comprising a first actuator for operatively engaging the first lock bar, (b) a second arm segment operatively connected to the first arm segment and comprising a second actuator for engaging the second lock bar, the second arm segment or the first arm segment defining an elongated asymmetrical slot comprising first and second slot portions, (c) a biasing element for urging the first and second arm segments between first and second positions defined along the longitudinal axis; and (ii) a lock housing assembly comprising a lock drive shaft extending through the asymmetrical slot, the shaft comprising a retainer with a defined diameter; and the first slot portion defining a width less than the diameter of the retainer, and the second slot portion defining a diameter greater than the diameter of the retainer.

19. The storage unit claimed in claim 18 comprising a detent for releasably securing the first arm segment to the second arm segment.

20. The storage unit claimed in claim 19 Wherein the detent comprises a projection on one of the first and second arm segments, and a stop on the other of the first and second arm segments; and the projection engages the stop when a portion of one of the arm segments is inserted into a receiving channel defined by the other of the arm segments.

* * * * *